US008696230B2

(12) United States Patent
Sanz Gamboa

(10) Patent No.: US 8,696,230 B2
(45) Date of Patent: Apr. 15, 2014

(54) SELF-ALIGNING COUPLING FOR LIFT GUIDES

(75) Inventor: Jesus Sanz Gamboa, Vera de Bidasoa (ES)

(73) Assignee: S.A. de Vera (Savera), Vera de Bidasoa (Navarra)

( * ) Notice: Subject to any disclaimer, the term of this patent is extended or adjusted under 35 U.S.C. 154(b) by 9 days.

(21) Appl. No.: 13/440,778

(22) Filed: Apr. 5, 2012

(65) Prior Publication Data

US 2012/0263554 A1 Oct. 18, 2012

(30) Foreign Application Priority Data

Apr. 18, 2011 (ES) ..... 201130614

(51) Int. Cl.
*B25G 3/00* (2006.01)

(52) U.S. Cl.
USPC ..... 403/286; 187/408

(58) Field of Classification Search
USPC ..... 403/286, 300, 403, DIG. 15; 52/848, 52/849; 187/406, 408
See application file for complete search history.

(56) References Cited

U.S. PATENT DOCUMENTS

2006/0070824 A1* 4/2006 Sanz Gamboa ..... 187/406

FOREIGN PATENT DOCUMENTS

ES 2320949 A1 5/2009

* cited by examiner

*Primary Examiner* — Michael P Ferguson
*Assistant Examiner* — Daniel Wiley
(74) *Attorney, Agent, or Firm* — Lucas & Mercanti, LLP

(57) ABSTRACT

A self-aligning coupling for lift guides, which consists of a core-mushroom element and wings. Each wing carries a through hole in its coupling zone and there are:

Figure 1A:
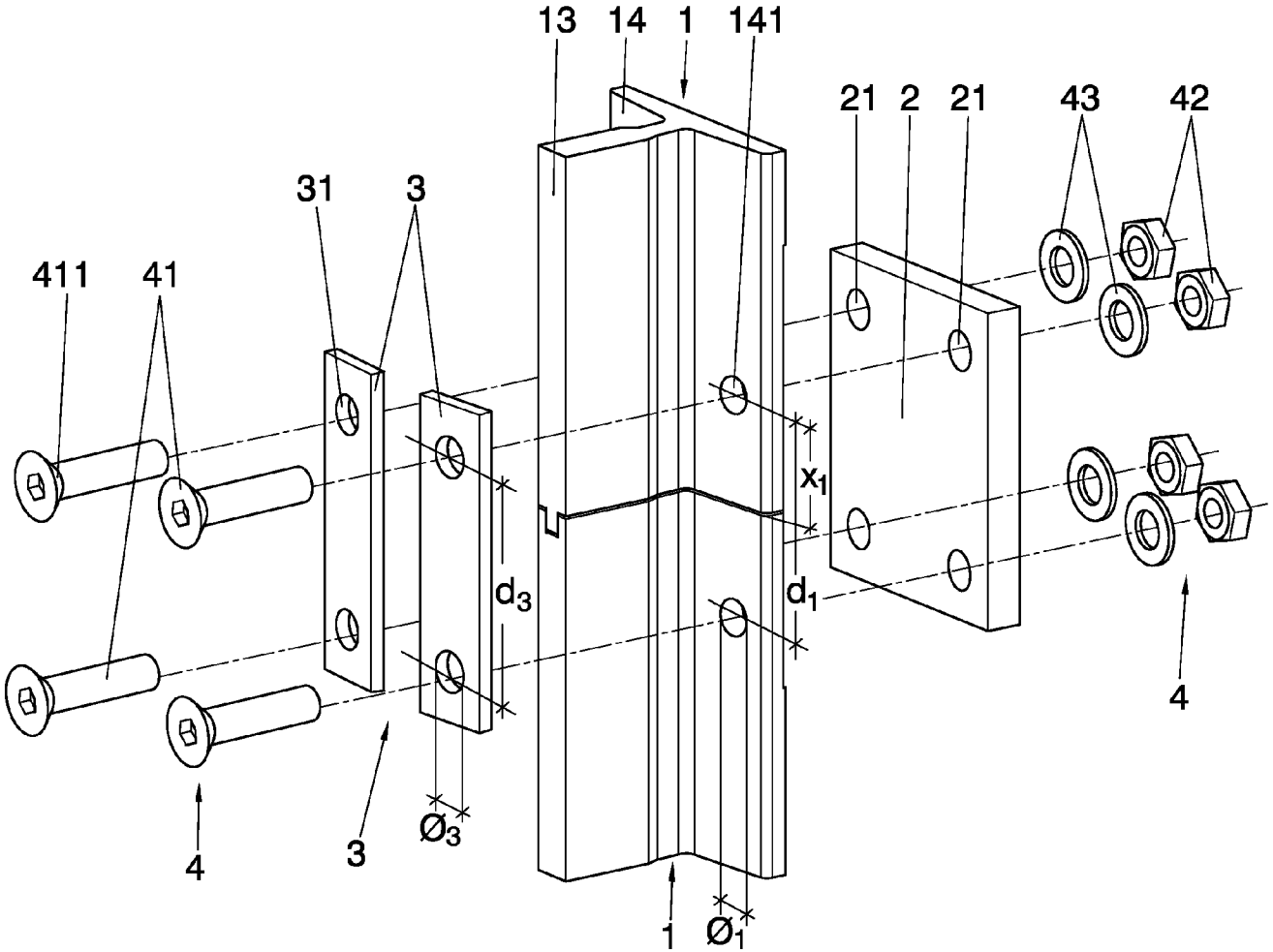

- under the wings an extra-flat plate provided with four through holes in correspondence with the orifices of two guides to be joined;
- on top of the wings, two extra-flat plates, each provided with two through holes in correspondence with two orifices of two guides to be joined.
- in said orifices, and retaining screws fastened with nuts; said screws presenting a conical head.

The orifices of the plates are of greater diameter than the orifices of the wings.

The distance between the orifices of the plates is shorter than the distance between the two orifices of the wings of the same side.

2 Claims, 6 Drawing Sheets

SELF-ALIGNING COUPLING FOR LIFT GUIDES

This Application claims the priority of Spanish Application No. P201130614, filed Apr. 18, 2011, the entire content of which is hereby incorporated by reference.

This invention concerns a coupling system with self-alignment for lift guides.

In the current state of the art, various types of systems are known for coupling of lift guides which tend to self-align said guides. The applicant has developed lift guides with self-aligning couplings of this type and, among other patents, is the owner of Patent ES2320949, which exert lateral pressure of alignment between the guides and their coupling plates.

The self-aligning coupling for lift guides which is the object of the invention supposes a substantial improvement with respect to the known solutions, in that the pressure is generated through auxiliary parts that force the screws to take a specific position. Moreover, this self-aligning coupling, according to the invention, provides other advantages, both from the structural viewpoint (because it improves the mechanical performance) and from the economic viewpoint (because less material is used). It is characterized in that:

a) each wing of the guide is provided with a through hole in its coupling zone;

b) it has a plate under the wings, this plate being of extra-flat configuration and provided with four through holes in positional correspondence with said orifices made in the wings of two guides to be joined;

c) both plates are placed on top of the wings, each plate being of extra-flat configuration and provided with two through holes in positional correspondence with two orifices made in the wings of two guides to be joined;

d) the orifices of said top plates are of greater diameter than the orifices in the wings of the guides;

e) the distance between the orifices of the top plates is shorter than the distance between the two orifices in the wings of the same side that said plate interrelates;

f) there are means of retention in said axially aligned orifices, means that apply pressure and compress the wings of the guides between the upper plates and the lower plate, while, due to the aforementioned differences between diameters and distances, exerting a light frontal pressure on the guides to produce their alignment, because the contact faces are perfectly machined at 90° with respect to the mushroom element of the guide.

In particular, said means of retention are sets of screws and nuts, with or without washers, where the screws present a conical zone under their head; said conical zone enters into contact and is lodged in the orifices of the corresponding upper plate only when the screw is inserted practically in its entirety, at which time the screws of the same side tend to come nearer and a light frontal pressure is generated on the guides, producing their self-alignment.

To better understand the object of this invention, a preferential form of practical embodiment is represented in the drawings, subject to accessory changes that do not essentially alter it.

Figure 1B:
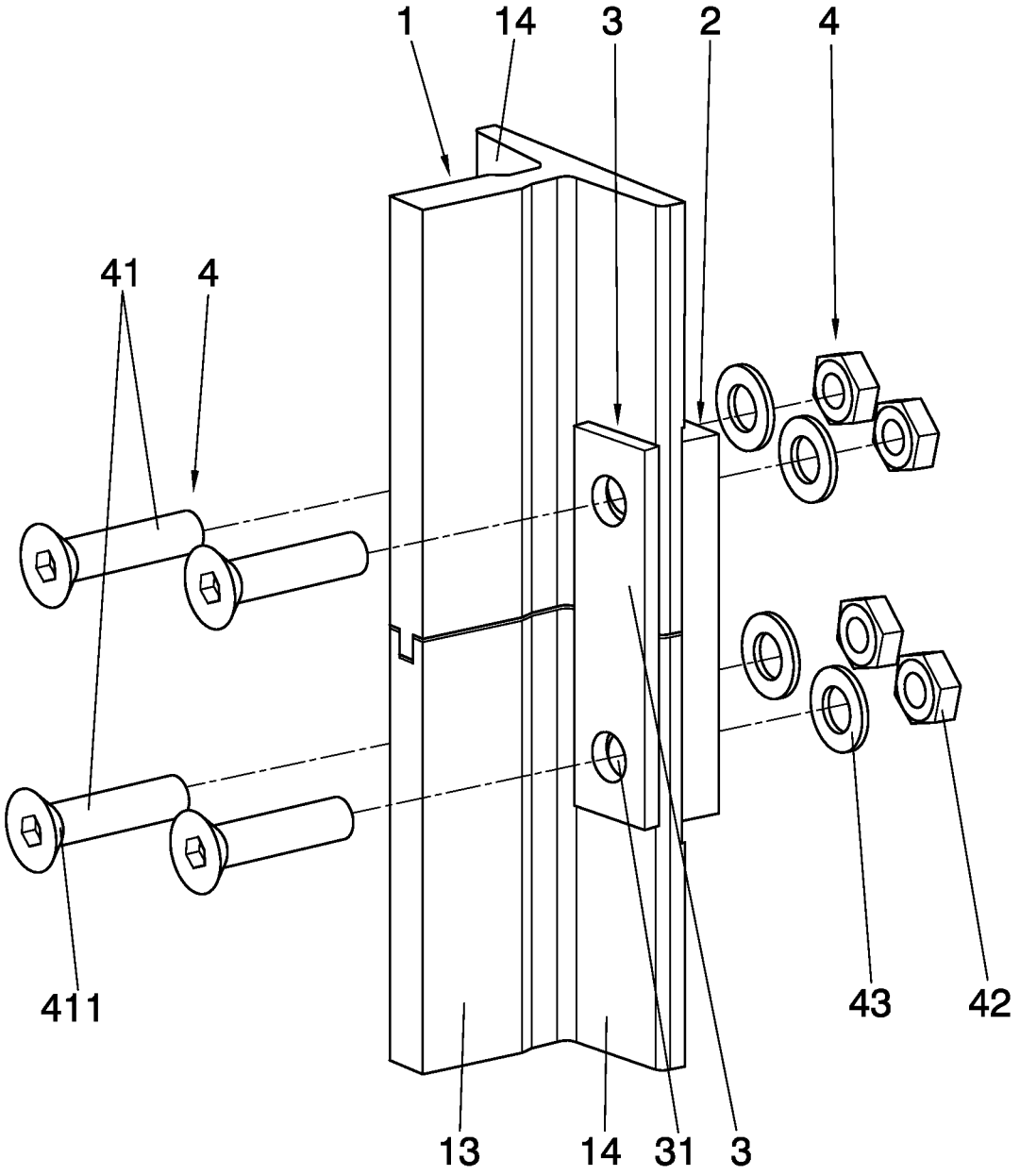
Figure 1C:
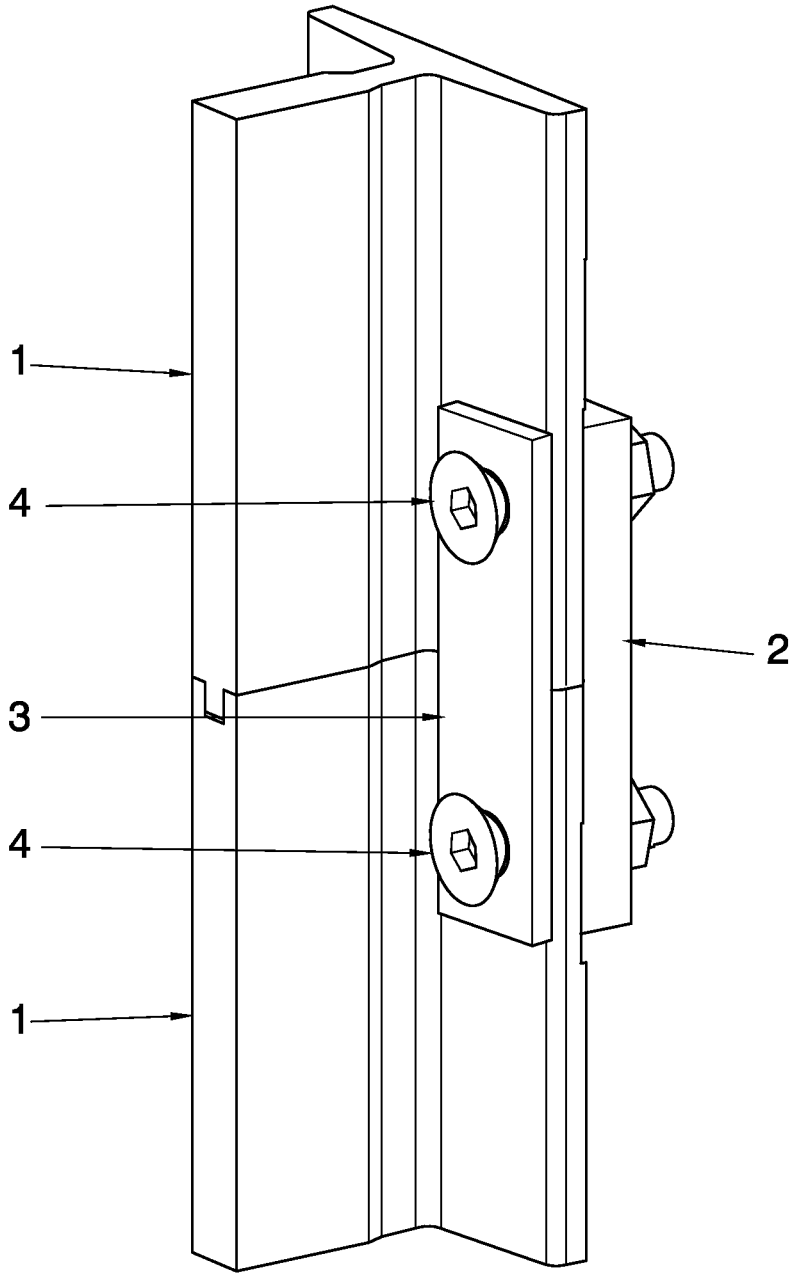

FIG. 1*a*, 1*b* and 1*c* are each general perspective views of the parts composing the self-aligning coupling, according to the invention, in three successive assembly phases.

Figure 2A:
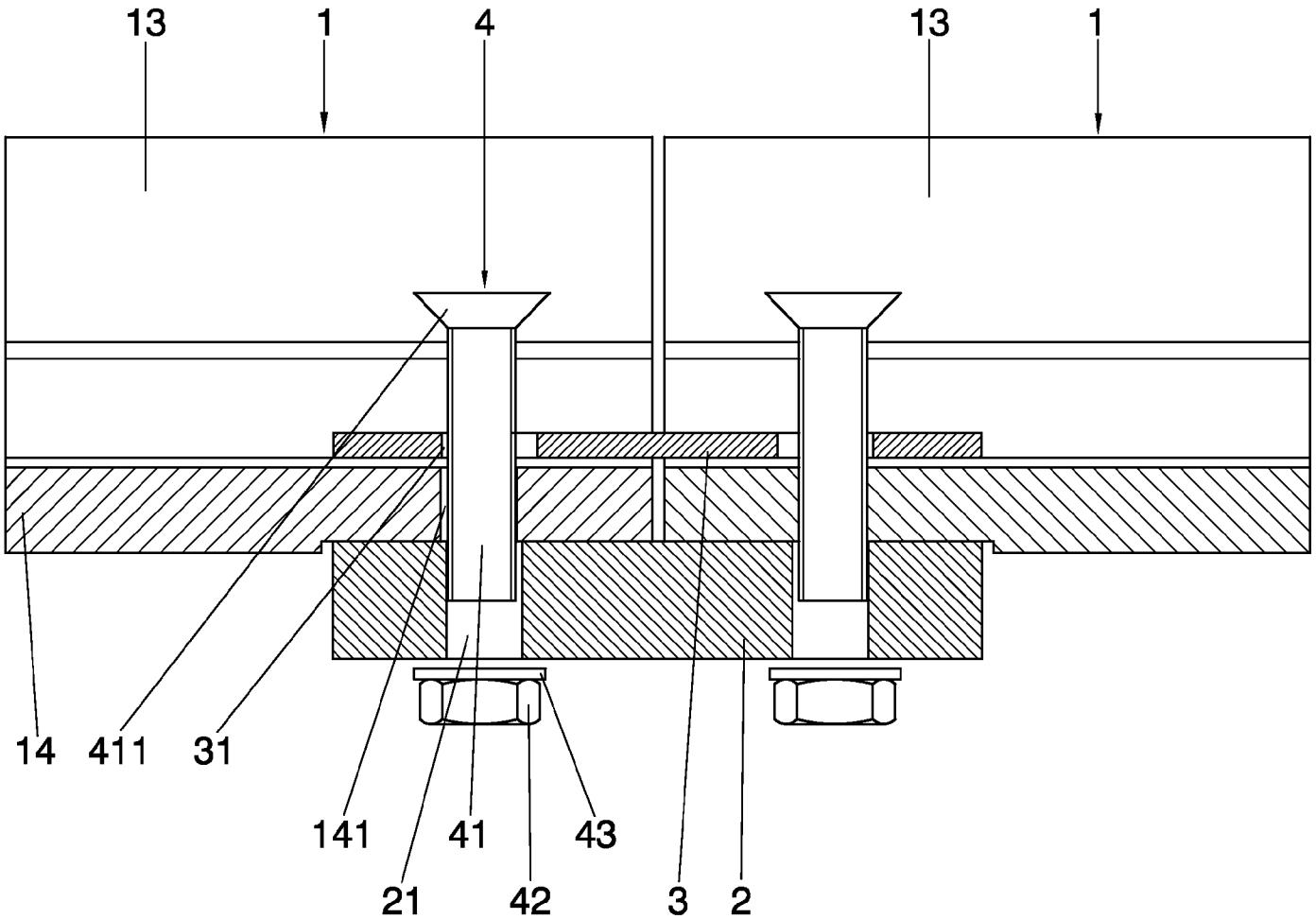
Figure 2B:
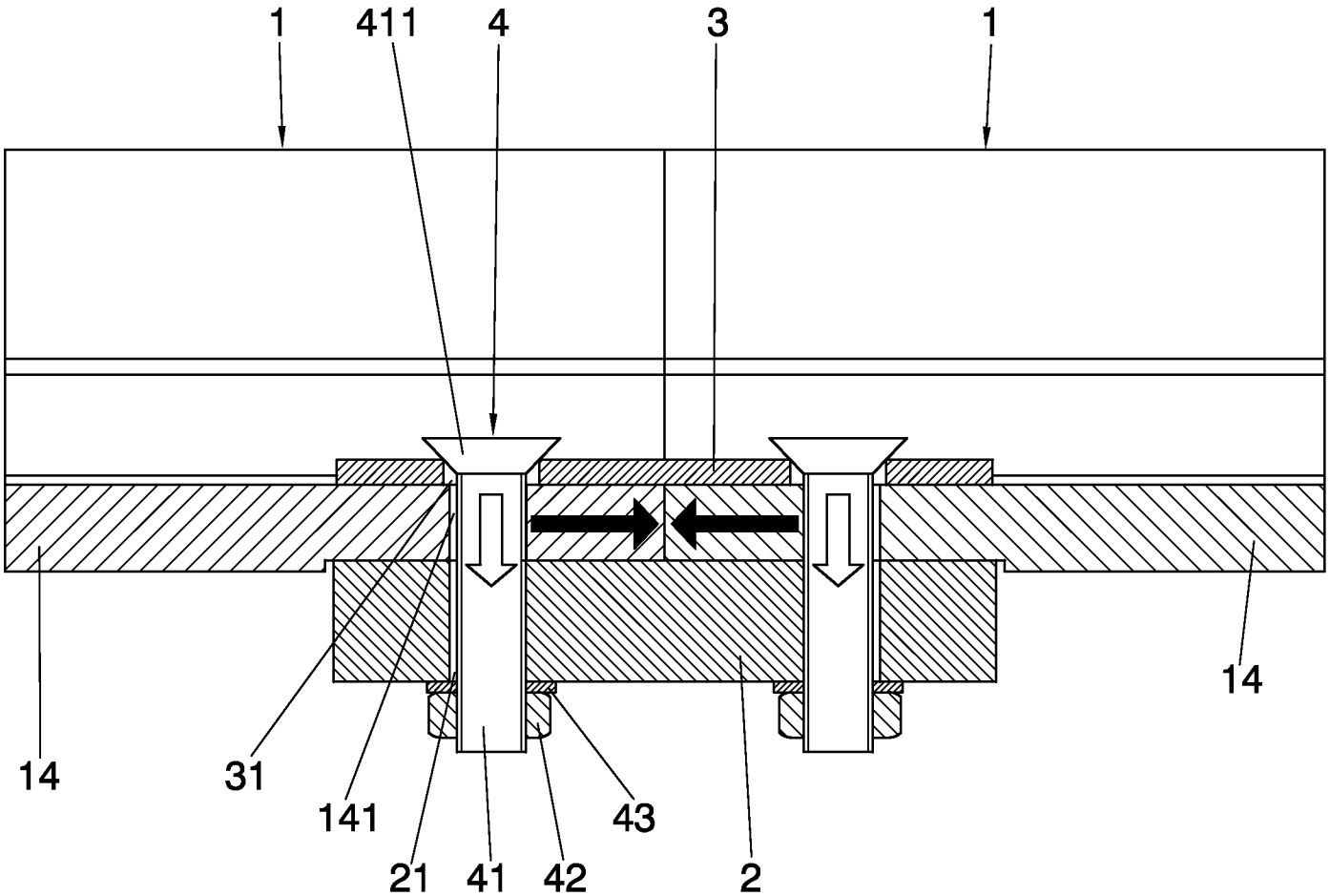

FIGS. 2*a* and 2*b* are longitudinal sections, in detail, for the example of embodiment of the foregoing figures in two successive assembly phases:

in FIG. 2*a*, before inserting the screws (41), the edges of the mushroom element (13) and of the wings (14) are separate;

in FIG. 2*b*, with the screws (41) inserted, the edges of the mushroom element (13) and of the wings (14) self-align (The vertical forces of the advance of the screws and the horizontal forces that produce the self-alignment have been represented with arrows).

Figure 3:
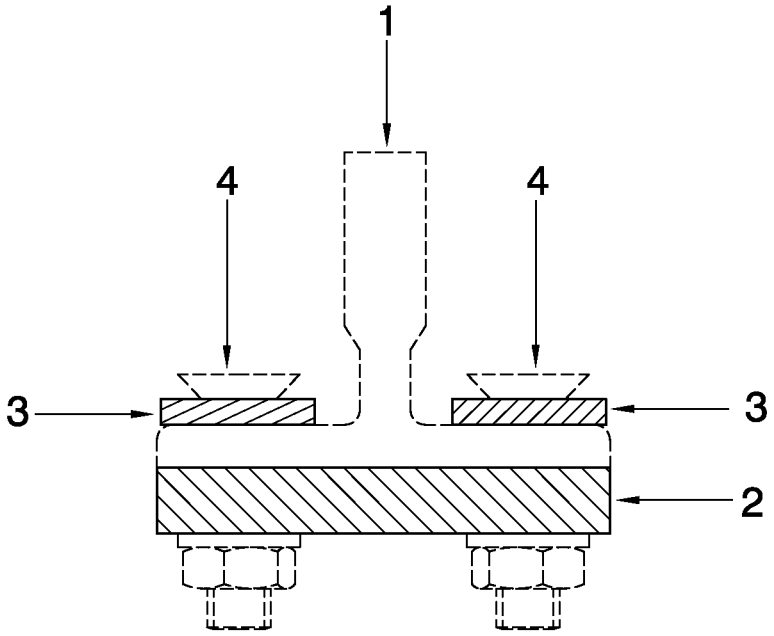

FIG. 3 is a cross-section, in detail, for the example of embodiment of FIGS. 1*a*, 1*b*, and 1*c*.

The following is a description of an example of practical, non-limiting embodiment of this invention.

The coupling with self-alignment for lift guides which is the object of the invention is utilized on guides, (1) of which comprise a core-mushroom element (13) and one wing (14) on each side.

According to the invention, each wing (14) forms in origin, an orifice (141), in its coupling zone; said orifices (141) being placed in opposite pairs, one on each wing (14). Each pair of orifices (141) corresponding to a guide (1) is machined at a pre-set distance; for example, the last of whose pairs is machined at a distance ($x_1$) from the end of the guide (1)—see FIG. 1*a*.

According to the invention, there is a plate (2) under the wings (14). This plate (2) is of extra-flat configuration and carries four through holes (21) in positional correspondence with the aforementioned orifices (141) of two guides to be joined; therefore, on said plate (2), the distance between two orifices (21) opposite two orifices (141) of the same side and corresponding to two guides (1) to be joined, will be double the aforementioned distance ($x_1$); and obviously, the distance between two contiguous orifices (21) will be the same distance as between two orifices (141) made in the two wings (14) of the same guide (1).

According to the invention, there are several plates (3) on the wings (14). Each plate (3) is of extra-flat configuration and carries two through holes (31) in positional correspondence with two orifices (141) made in the wings of two guides (1) to be joined corresponding to the same side; therefore, on each plate (3), the distance between its orifices (31) will be double the aforementioned distance ($x_1$).

Also fulfilled in the configuration and particulars of the above mentioned components, which comprise the self-aligning coupling, according to the invention:

the orifices (31) of the plates (3) are of greater diameter than the orifices (141) of the wings (14): $\emptyset_3>\emptyset_1$;

the distance between the orifices (31) of the plates (3) is shorter than the distance between the two orifices (141) of the wings (14) of the same side that said plate interrelates (3): $d_3<d_1$;

According to the invention, there are means of retention (4) in said orifices (141), (31) and (21) which, due to the differences between diameters $\emptyset_3>\emptyset_1$ and distances $d_3<d_1$, apply pressure and compress the wings (14) between the upper plates (3) and the lower plate (2) while exerting a light frontal pressure on the guides (1) to produce their alignment.

In particular, according to the embodiment represented, the aforementioned means of retention (4) are sets of screws (41) and nuts (42), with or without washers (43); where the screws (41) present a conical head (411) which enters into contact and lodges in the orifices (31) of the corresponding upper plate (3) only when the screw (41) is inserted practically in its entirety, at which time they tend to come nearer, producing the self-alignment of the coupling.

The invention claimed is:

1. A lift guide coupling system comprising:

two adjacent lift guides, each lift guide having a core-mushroom element and a wing on each side of the core-mushroom element, each wing extending 90° from the core-mushroom element such that each of the lift guides has a T shaped cross section, with ends of the two adjacent lift guides abutting each other to form a coupling zone, each wing having a through hole in the coupling zone, each through hole having a diameter Ø1, and wherein the through holes in the wings of one of the two adjacent lift guides are separated from the through holes in the wings of the other of the two adjacent lift guides by a distance d1;

a single lower flat plate under the adjacent lift guides in the coupling zone, the lower flat plate abutting each wing of the adjacent lift guides on a side opposite the core-mushroom elements of each lift guide, the lower flat plate having four through holes, wherein each of the four through holes aligns with a respective one of the through holes in each wing in the coupling zone;

two upper flat plates, the two upper flat plates separated by the core-mushroom element, one of each of the upper flat plates extending across the adjacent lift guides on top of a respective wing of each of the adjacent lift guides in the coupling zone, each of the upper flat plates having two through holes that correspond to the through holes in each wing in the coupling zone of the adjacent lift guides, each of the through holes in each of the upper flat plates having a diameter Ø3, and Ø3>Ø1, where the through holes on each upper flat plate are separated by a distance d3, and d3<d1; and retention means, the retention means comprising a bolt with a conical head and a threaded shaft extending therefrom, the shaft passing through each of the through holes of the upper flat plates, a corresponding through hole of the wing, and a corresponding through hole of the lower flat plate, and threadingly engaging with a nut disposed under the lower flat plate, thereby compressing each wing between the upper flat plates and the lower flat plate, and whereby when the conical heads of the retention means engage the through holes of the upper flat plates, the shafts of the retention means exert a lateral pressure on the adjacent lift guides to produce an alignment between the adjacent lift guides because Ø3>Ø1 and d3<d1.

2. The coupling system of claim 1, wherein the retention means further comprise washers.

* * * * *